US006926165B2

(12) United States Patent
Conti

(10) Patent No.: US 6,926,165 B2
(45) Date of Patent: Aug. 9, 2005

(54) TAMPER-EVIDENT CONTAINER

(75) Inventor: Rino Conti, Stoughton, MA (US)

(73) Assignee: Plastican, Inc., Leominster, MA (US)

( * ) Notice: Subject to any disclaimer, the term of this patent is extended or adjusted under 35 U.S.C. 154(b) by 0 days.

(21) Appl. No.: 10/413,543

(22) Filed: Apr. 14, 2003

(65) Prior Publication Data

US 2004/0200839 A1 Oct. 14, 2004

(51) Int. Cl.[7] ..... B65D 41/04; B65D 50/00; B65D 45/22

(52) U.S. Cl. ..... 220/288; 220/269; 220/302; 220/326; 215/47; 215/216; 215/217; 215/220; 215/221; 215/223; 215/253; 215/321

(58) Field of Search ..... 215/213, 220, 215/223, 250, 253, 301, 321, 221, 46, 47, 209, 216, 217, 218, 219, 330, 331; 220/269, 209, 302, 266, 268, 288, 324, 326, 784, 790

(56) References Cited

U.S. PATENT DOCUMENTS

| | | | | | |
|---|---|---|---|---|---|
| 3,744,655 | A | * | 7/1973 | Nixdorff | 215/216 |
| 3,805,987 | A | * | 4/1974 | Horvath | 215/252 |
| 3,881,625 | A | * | 5/1975 | Landen | 215/221 |
| 3,891,110 | A | * | 6/1975 | Gach | 215/216 |
| 3,902,620 | A | * | 9/1975 | McIntosh | 215/209 |
| 3,944,101 | A | * | 3/1976 | Landen et al. | 215/216 |
| 4,014,452 | A | * | 3/1977 | Galer | 220/659 |
| 4,261,478 | A | * | 4/1981 | Summers | 220/270 |
| 4,298,132 | A | * | 11/1981 | Galer | 220/288 |
| 4,310,102 | A | * | 1/1982 | Walter | 220/288 |
| 4,548,329 | A | * | 10/1985 | Curry | 215/216 |
| 4,555,042 | A | | 11/1985 | Rathbun | |
| 4,630,743 | A | * | 12/1986 | Wright | 215/216 |
| 4,727,998 | A | * | 3/1988 | Simon | 215/230 |
| 4,934,547 | A | * | 6/1990 | Mayes et al. | 215/306 |
| 5,224,617 | A | | 7/1993 | Gaudreault | |
| 5,307,948 | A | * | 5/1994 | Blackburn et al. | 220/269 |
| 5,411,160 | A | | 5/1995 | Goulet et al. | |
| 5,437,386 | A | | 8/1995 | Von Holdt | |
| 5,544,768 | A | * | 8/1996 | Gargione | 215/209 |
| 5,711,442 | A | * | 1/1998 | Kusz | 215/209 |
| 5,785,203 | A | * | 7/1998 | Arshinoff et al. | 220/783 |
| 5,865,330 | A | * | 2/1999 | Buono | 215/216 |
| 5,873,482 | A | | 2/1999 | Conti | |
| 6,036,036 | A | * | 3/2000 | Bilani et al. | 215/216 |
| 2003/0085227 | A1 | * | 5/2003 | Azzarello | 220/266 |

* cited by examiner

*Primary Examiner*—Lee Young
*Assistant Examiner*—James Smalley
(74) *Attorney, Agent, or Firm*—Pandiscio & Pandiscio

(57) ABSTRACT

The combination of a container and a screw-type lid is improved by a tamper-evident feature comprising a locking tab on the exterior of the container having upwardly facing teeth and mating teeth on the lid, the teeth on the container and lid being arranged so as be slidable relative to one another while in mutual engagement when the lid is rotated in one direction and to lock to one another when the lid is urged to rotate in an opposite direction. The tab is tearable to terminate the locking action, thereby evidencing tampering. A catch member formed on the container is positioned to engage and cam one of several latch lugs formed on the lid, whereby to establish a locking action with that latch lug. The catch member prevents removal of the lid from the container until the engaged latch lug is pressed inwardly far enough for it to be released from the catch member, whereupon the lid may be unscrewed from the container.

11 Claims, 6 Drawing Sheets

TAMPER-EVIDENT CONTAINER

FIELD OF THE INVENTION

The present invention pertains to containers closed off by a lid or cover and means evidencing tampering of the container closure.

PRIOR ART

Heretofore efforts have been made to provide containers of the type having removable closures with means evidencing efforts to remove the closures. It is especially desirable to have a tamper-evident means for indicating if a container has been opened in the case where it is filled with food, drugs, medicines, or a material that is toxic or irritating to the skin. Tamper-evident means are also desirable to reduce pilfering, e.g., when the containers are filled with small, expensive electronic semiconductor devices. In some cases the tamper-evident means also may serve to render the closures difficult for children to open. Commonly the tamper evident means is either formed integral with the closure or constitutes a separate component that is engaged with both the closure and the container.

OBJECTS AND SUMMARY OF THE INVENTION

A primary object is to provide a container with novel means for indicating that an effort has been made to remove its cover or lid to gain access to its contents.

A further object is to provide a plastic container with a removable closure characterized by a tamper-evident means formed integral with the container and engaged by the closure.

Another object is to provide containers with reusable covers or lids that are characterized by novel means for evidencing tampering with the sealed closure.

Still another object is to provide a container closure system that includes a tamper-evident means and a child safety lock.

The foregoing objects, and other objects stated in or rendered obvious by the following specification are achieved by providing (1) a container and (2) a closure in the form of a cover or lid that fits over and makes a releasable connection with the open top end of the container, with the container being formed with a tamper evident member that is engaged by and makes an interlocking connection with the cover or lid. The tamper evident member is in the form of a tab that is breakable under pressure so that, once broken, it is disengaged from the cover or lid. In the preferred embodiment of the invention the cover or lid has teeth on its underside that interlock with teeth on the breakable tab. The tab functions as a tamper evident feature, since the fact that it has been broken can be easily discerned from inspection and since the torn tab cannot be restored to its original condition. In the preferred embodiment the cover or lid is attached to the container by a screw connection comprising external threads near the top end of the container and internal threads on the lid. When the lid or cover is screwed onto the container it forms a leak-proof seal with the container. In addition, the lid is provided with latch means that contact catch means on the exterior of the container to securely retain the lid on the container.

Other features and advantages of the invention are stated in or rendered obvious by the following detailed description of the preferred embodiment of the invention which is to be considered together with the accompanying drawings.

BRIEF DESCRIPTION OF THE DRAWINGS

In the several figures, like numerals designate like components.

DETAILED DESCRIPTION OF THE INVENTION

Figure 1:
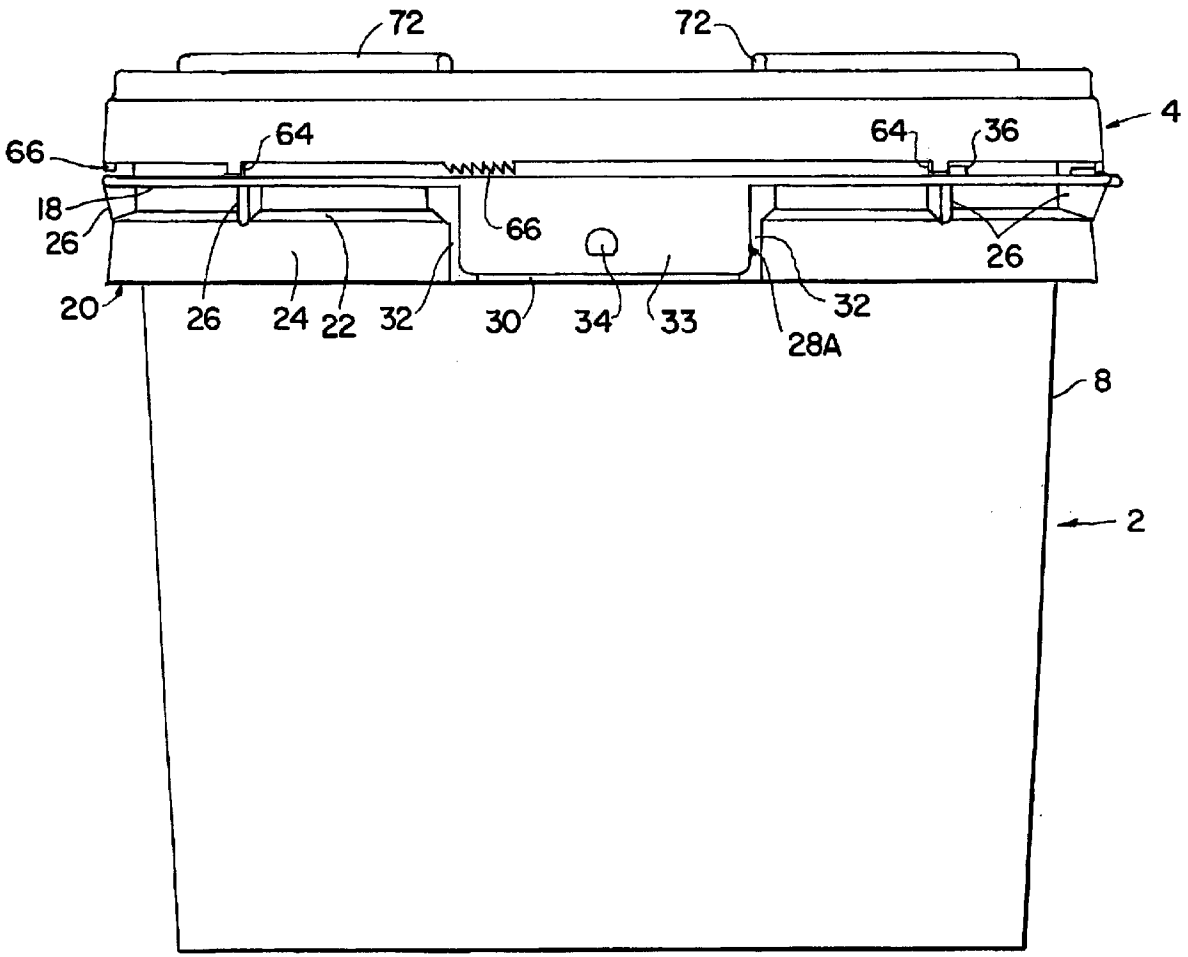
FIG. 1 is a side view in elevation showing a container and attached lid embodying the present invention.

Referring to FIGS. 1–8, a preferred embodiment of the invention comprises a circular container 2 and a lid or cover 4. Both the lid and the pail are molded of a plastic material that is relatively stiff yet resilient, e.g., polyethylene, polypropylene or another moldable thermoplastic resin.

Container 2 comprises a side wall 8 that preferably is tapered inwardly from top to bottom by several degrees, i.e., the o.d. of the bottom end is smaller than the o.d. of the upper end of the pail, so as to permit a number of containers (without lids) to be stacked one inside the other for storing and shipping purposes. The upper end of side wall 8 has a peripheral outwardly-extending radial flange 10 (FIGS. 3, 6, 8) that serves to provide resistance to lateral deformation of the upper end of the container and also serves as a seat for lid 4.

Formed on the outer surface 12 of side wall 8 below flange 10 are four pairs of vertically spaced ribs 14A, 14B that are inclined relative to the plane of flange 10 so as to serve as helical screw threads. In the following text ribs 14A, 14B are referred to as screw thread segments. The four pairs of screw thread segments are uniformly spaced from one another along the circumference of the side wall. Each screw-thread segment extends circumferentially through an angle of about 42°.

The upper end of the container also is rigidized by a circumferentially-extending exterior flange 18 located below the screw thread segments and a skirt 20 that is located below flange 18. Skirt 20 comprises an inclined radially-extending top portion 22 attached to side wall 8 and a depending side portion 24. The latter may extend parallel to the longitudinal center axis of the container, but preferably it is slanted as shown. A plurality of spaced radially-extending strengthening ribs 26 are formed integral with the exterior surface of side wall 8, flange 18 and skirt 20.

At two diametrically opposed areas the container has two outwardly-projecting sections 28A, 28B that are generally U-shaped in cross-section and have an outwardly projecting lip 30 at their bottom edges. Sections 28A, 28B consist of a top wall portion 31 as part of flange 18, two opposite side wall portions 32 and an outer wall portion 33. Sections 28A, 28B are open at their bottom ends and their outer wall portions 33 are spaced from side wall 8 by an amount sufficient to accommodate a person's fingers, whereby sections 28A, 28B can function as handles for lifting the container with or without lid 4 attached thereto. Preferably handle sections 28A, 28B are provided with holes 34 (FIG. 1) to pivotally accommodate the ends of a bail (not shown) whereby the container may function as a pail (bucket).

Figure 3:
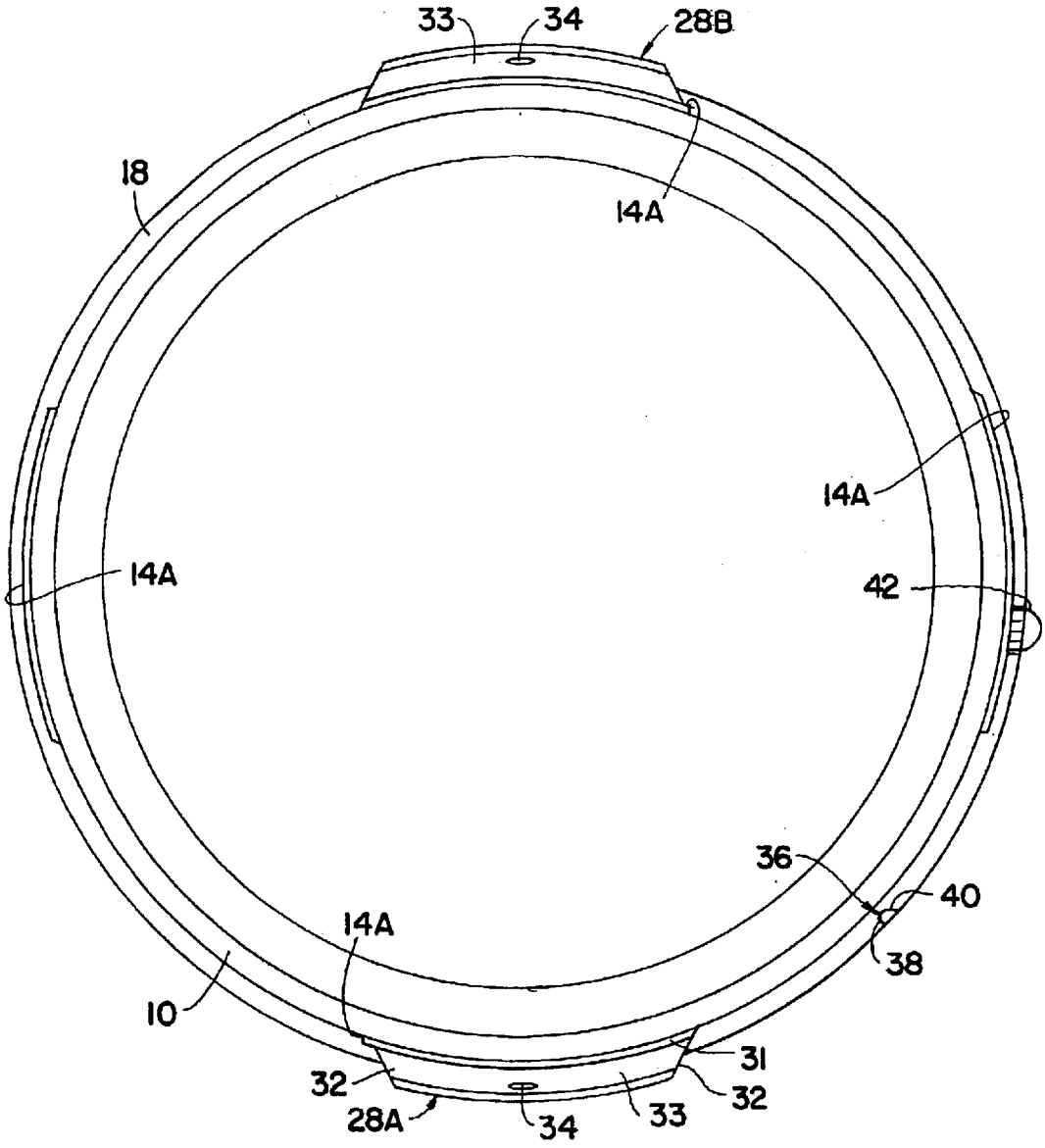
FIG. 3 is a plan view of the container with the lid removed.
Figure 4:
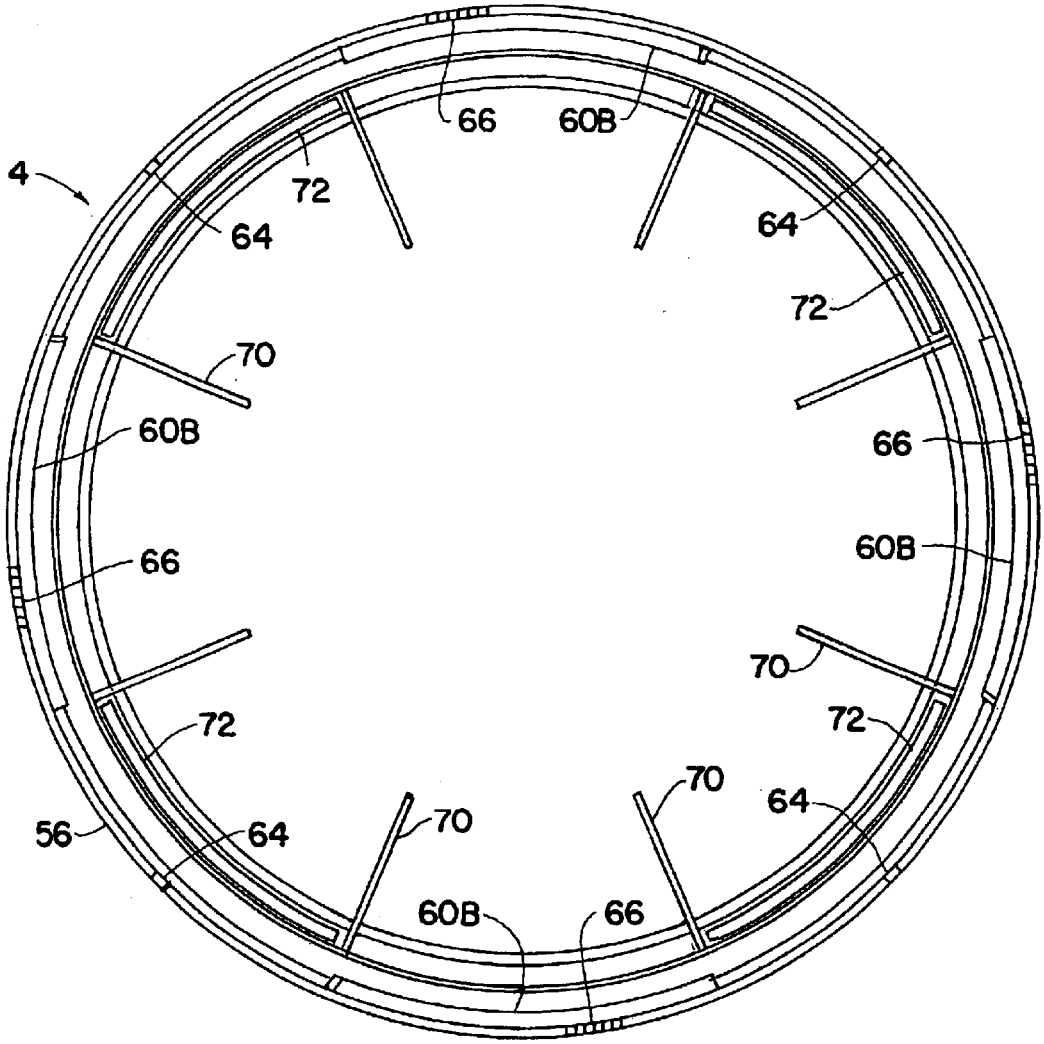
FIG. 4 is a bottom view of the lid.

Referring to FIGS. 1 and 3, the upper surface of flange 18 is provided with a vertically extending catch element 36 that has one side surface 38 that extends substantially along a radius of the container and an opposite side surface 40 that is slanted inwardly in a clockwise direction, so that its outer edge is further from side surface 38 than its inner edge. The slanted surface 40 leads the radial surface 38 in a counter-clockwise direction along the circumference of the container.

Figure 5:
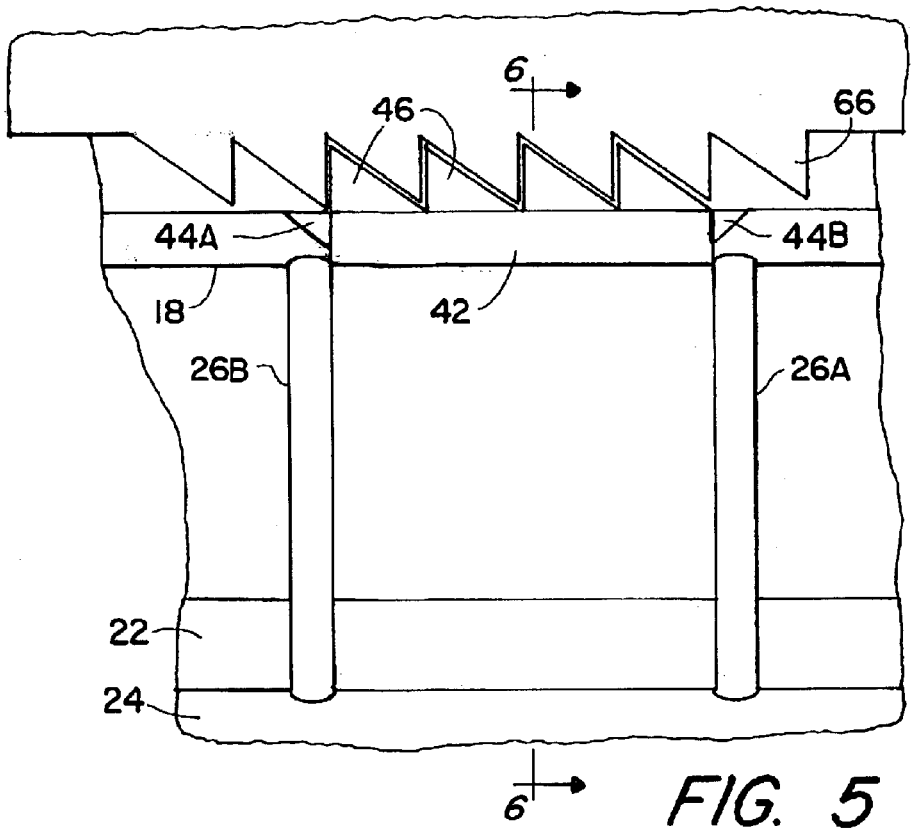
FIG. 5 is fragmentary side view in elevation on an enlarged scale of the same container and lid illustrating the interlocking relationship of the locking tab with the teeth on the lid.
Figure 6:
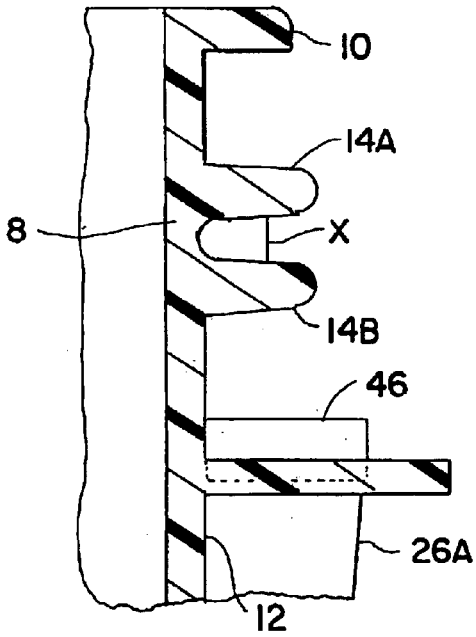
FIG. 6 is a sectional view in elevation of the upper end of the container taken along line 6—6 of FIG. 5.

Referring now to FIGS. 2, 3 and 5–8, the container is provided with a tamper-evident lock means in the form of a radially-extending tab 42 that is an integral part of flange 18. Tab 42 projects outwardly of the periphery of flange 18 and is demarcated by a pair of parallel grooves 44A, 44B formed in flange 18. A plurality of upwardly extending teeth 46 are formed on the upper side of tab 42. As seen in FIG. 5, the teeth are of sawtooth shape, having a vertically extending trailing edge and an inclined leading edge. As viewed in FIG. 3, the inclined edges lead the vertical edges in a counter-clockwise direction along the circumference of the container.

Figure 2:
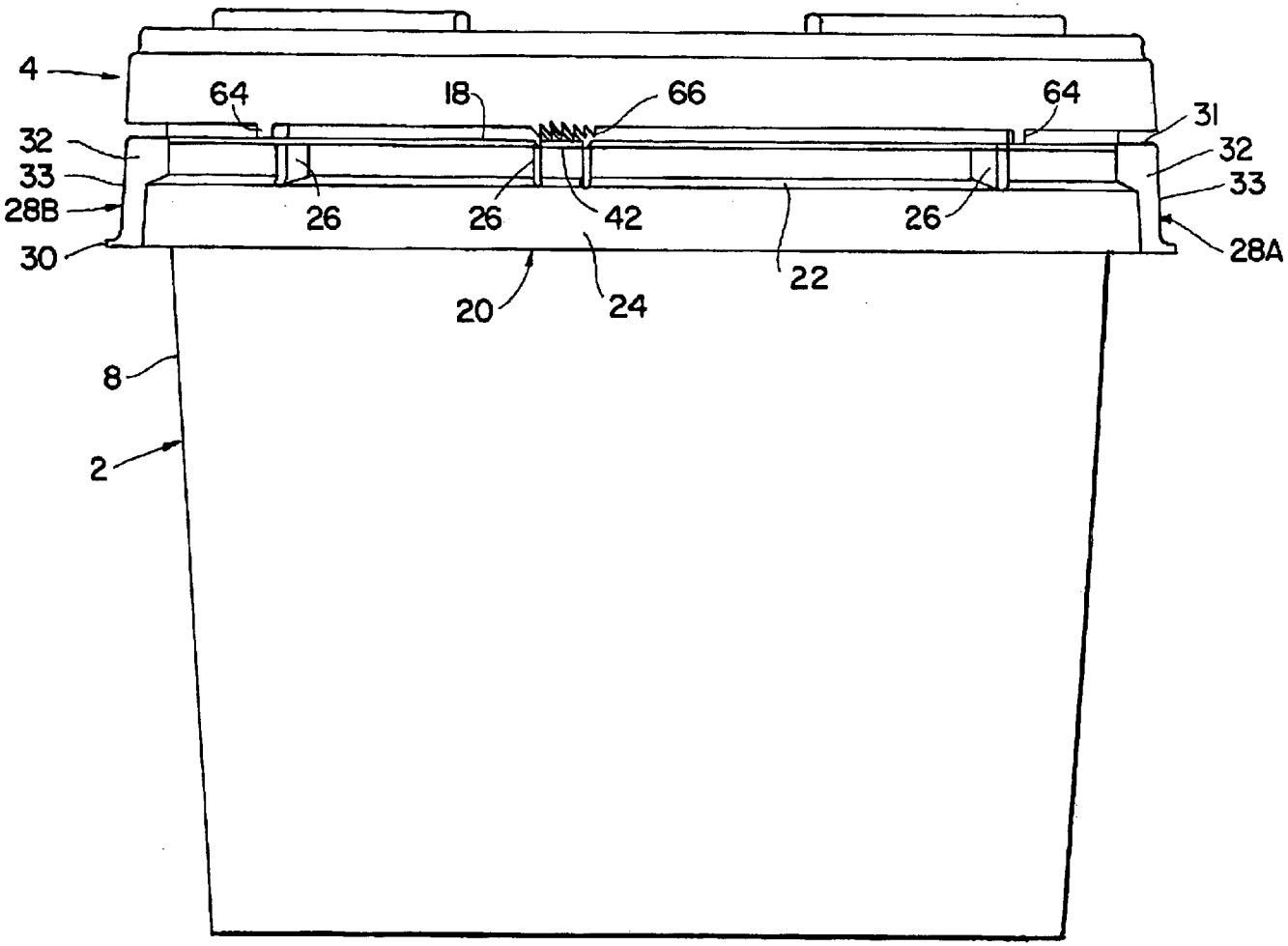
FIG. 2 is a side elevation of the same container and attached lid rotated 90° from the view of FIG. 1.

Grooves 44A, 44B are defined by a vertical side wall and an inclined bottom wall, with the vertical side walls defining the side edges of tab 42. Two of the ribs 26 (26A, 26B), are located in line with grooves 44A, 44B, as shown in FIGS. 2 and 5, to provide support for flange 18 and thereby facilitate rupture of tab 42 along those grooves. The depth of the grooves is sufficient to allow tab 42 to be severed from flange 18 by a manually applied rupturing force, but not so great as to allow the connection between the tab and rib to be broken accidentally. When rupture occurs along grooves 44A, 44B, the inner end of tab 42 will still be attached to side wall 8, allowing the connection of the tab to wall 8 to function as a hinge whereby the tab can be swung down close to side wall 8.

Referring to FIGS. 1, 2, 4 and 8, lid 4 is formed with a main body section 50 and a rim section 52 that comprises a cylindrical depending inner wall 54 and a circular depending outer wall 56 that is spaced from the inner wall so as to define a channel sized to accommodate flange 10 of the container. The outer wall is slanted so that the width of the channel is greater at its bottom, i.e., at its mouth.

Outer wall 56 is formed with four pairs of vertically spaced circumferentially-extending ribs 60A, 60B that are inclined so as to serve as screw thread elements, like the ribs 14A and 14B. Ribs 60A, 60B are spaced apart and have the same pitch as ribs 14A and 14B. The four pairs of screw thread segments 60A, 60B are uniformly spaced from one another along the circumference of the lid. Each screw thread segment extends circumferentially through an angle of about 42°. Additionally the lower edge of outer wall 56 is provided with four depending latch lugs 64 that are uniformly spaced along the circumference of the lid, plus four sets of teeth 66. The latter have a sawtooth configuration and are sized and arranged to mesh with teeth 46 of tab 42. The four sets of teeth 66 occur alternately with catch lugs 64 on lid 4, and lugs 64 are located relative to screw thread segments 60A, 60*b* so that one of the lugs 64 will be adjacent to and blocked by catch element 36 (as shown in FIG. 1) when the lid has been screwed onto the container with one set of its teeth 66 engaged with teeth 46 (as shown in FIGS. 2 and 5).

Figure 8:
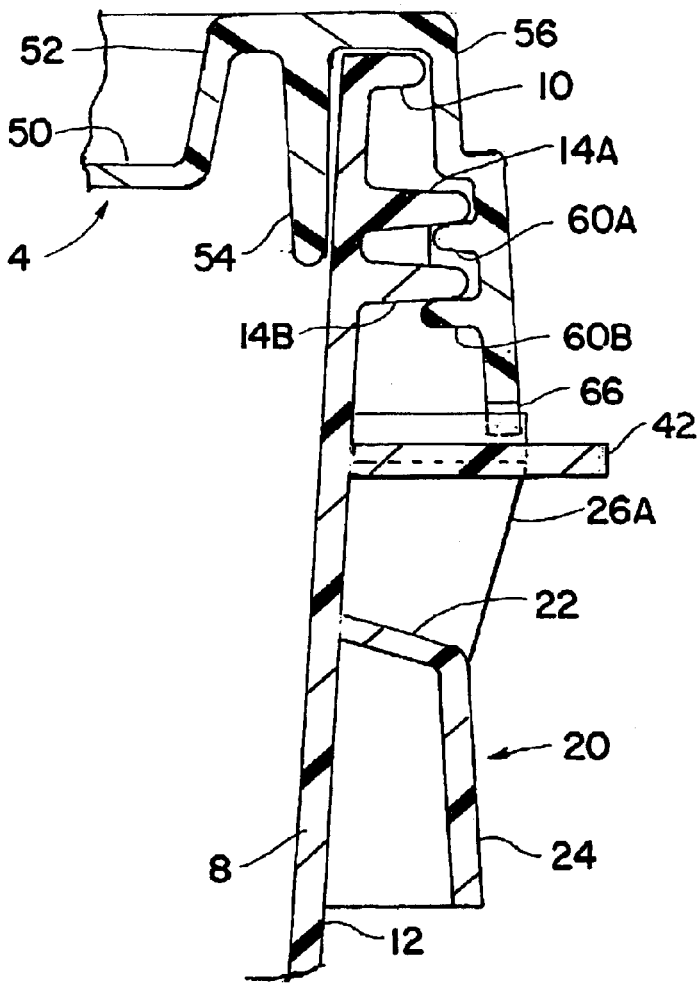
FIG. 8 is a fragmentary sectional view in elevation similar to FIG. 6 but with the lid attached to the container in engaged relation with the locking tab.
Figure 7:
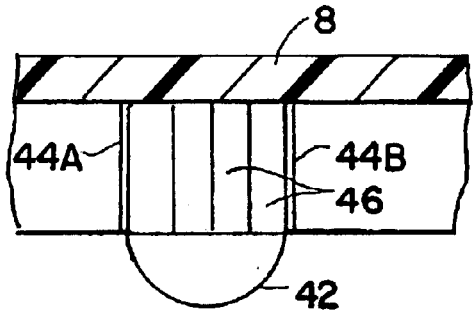
FIG. 7 is a fragmentary cross-sectional view of the container illustrating the upper side of the tab.

Preferably, as seen in FIG. 8, the body section 50 of the lid is depressed relative to its rim section and is formed with a series of radially-extending ribs 70 on its bottom side that serve to stiffen the body section. As an optional measure, the lid is formed with four vertically-projecting arcuate ribs 72 (FIG. 1) on its upper side that can serve as a grip to facilitate manual unscrewing of the lid and also as stacking guides to facilitate stacking containers one upon the other.

The lid is assembled to the pail by engaging its screw threads segments 60A, 60B with the screw thread segments 14A, 14B of the container and rotating the lid clockwise to lock the lid in place with flange 10 at the top of the container in engagement with the underside of rim section 52 between inner and outer walls 54 and 56. If a fluid tight seal is required, an elastomeric sealing ring, e.g., an O-ring (not shown), may be installed in the lid in that upper end of the channel between walls 54 and 56 for engagement by flange 10, with the sealing ring being slightly compressed when the lid is screwed onto the container. Such use of an elastomeric sealing ring is well known, as shown, for example, by U.S. Pat. Nos. 5,725,122 and 5,577,632.

The locking of the lid on the container involves two locking mechanisms or actions involving catch element 36 and lips 66 and also teeth 46 and 66. As the lid is being screwed onto the pail, one of the latch lugs 64 will engage the slanted leading edge 40 of catch element 36 and the latter will provide a camming action that will bend the outer wall 56 of the lid inwardly far enough to allow that lug 64 to slip by the catch element. Due to the resiliency of the material of which the lid is molded, the cammed portion of the outer wall 56 will immediately return to its original shape, bringing the lug 64 back into alignment with the catch element, whereupon the catch element will prevent the lid from being unscrewed from the container unless the outer wall 56 is pressed inwardly enough to allow the blocked latch lug 64 to slip by the catch element. This need to press the outer wall 56 inwardly to free the blocked latch lug 64 constitutes a safety lock.

A second locking action is provided by the tamper evident tab 42. As one of the latch lugs 64 is being cammed inwardly by catch element 36, one of the sets of teeth 66 will engage and pass along teeth 46 on tab 42. Engagement of teeth 66 with teeth 46 to achieve the locked state shown in FIGS. 2 and 5 involve downward deflection of teeth 66 by teeth 46 (and also a lesser upward deflection of teeth 66) as a consequence of the inclined edges of sawteeth 66 producing a camming action as they ride up the inclined edges of sawteeth 46. However, with respect to unlocking the lid, the height (vertical dimension in FIG. 5) of the teeth 46 and 66 is sufficiently large to prevent their disengagement from one another by merely deflecting tab 42 downward away from the lid, since it is difficult to pry the lid upwardly due to the fact that teeth 66 make an exact fit with teeth 46. Instead the tab 42 must be pushed down with a force sufficient to cause the opposite sides of the tab to break away from flange 18 at grooves 44A and 44B, whereupon the tab can be pressed down far enough to separate teeth 46 from teeth 66. Once that has been accomplished, the lid can be unscrewed, but only if the outer wall 56 is pressed in far enough to allow the captured latch lug 66 to slide past the catch element 36. However, once the tab has been torn away along grooves 44A, 44B, it cannot be restored to its original state as an integral part of flange 18, thereby making evident that the tampering of the lid/container connection has occurred. It is to be noted that rupturing tab 42 along tear grooves 44A, 44B does not affect the locking action provided by catch element 36 and latch lugs 64.

It should be noted that a common industry practice is to apply a plastic screw-type lid to a container by a downward, non-rotating propulsion of the lid towards the container, i.e., by a press-on action. In this case such press-on action is feasible because the lid and container are made of a resilient material, e.g., polyethylene or polypropylene, and also because the outer wall 56 of the lid's rim is slanted outwardly as shown in FIG. 8. Although the lid and container each have four screw thread segments, it is contemplated that two, three or more than four segments may be used.

Preferably the container has only one catch element 36 as shown, since it has been determined that adequate safety locking is achieved with a single catch element. Nevertheless, for added safety, it is contemplated that the container may have two mutually spaced catch elements positioned so as to cam and block two latch lugs as described when the lid is screwed onto the container. Where two catch means are employed, such as shown in the preferred embodiment of the drawings, it is necessary to free two latch lugs 64 simultaneously from their catch elements 36 in order to permit counter-clockwise unscrewing of the lid. Such simultaneous movement is difficult for to accomplish even for an adult and provides an added measure of safety.

The invention lends itself to modifications. Thus, for example, different forms of screw threads may be used. Also, the container need not have handle sections as shown. Also locking tab 42 may be formed with a smaller thickness where it is joined to side wall 8, thereby permitting it to be torn away from the container. These and still other modifications, including reversal of parts and function, which are obvious to persons skilled in the art may be made without departing from the spirit and scope of the invention as herein disclosed.

What is claimed is:

1. A container/lid combination comprising:

a container having an open top end, a closed bottom end, and a side wall having an exterior surface extending from said open top end to said closed bottom end, said side wall being circular in cross-section and increasing in diameter with increasing distance from said bottom end, a plurality of first screw thread means on said exterior surface of said side wall adjacent to said open end, a peripheral flange formed integral with and projecting radially outward from said exterior surface below and spaced from said first screw thread means, and a tab comprising a section of said flange and demarcated by two mutually spaced radially-extending tab-tear grooves in said flange, said tab having an upper side facing in the direction of said first screw means and characterized by a first set of upwardly projecting teeth of saw-tooth shape extending in series between said grooves, said grooves having a depth such as to leave thin sections of said flange connected to said tab that are tearable to allow said tab to be bent downward from out of the plane of said flange, and a catch element projecting upwardly from said flange; and a circular lid having a main body section, a rim section formed integral with and surrounding said main body section, said rim section having a depending skirt at its periphery, said skirt having an internal surface and a bottom edge, said skirt being sized to surround said side wall at the top end of said container, a plurality of second screw thread means on said internal surface of said skirt, said second screw thread means being adapted to make a screw connection with said first screw thread means whereby said lid may be screwed onto said container, multiple sets of teeth projecting downwardly from said bottom edge, each set of said multiple sets of teeth comprising a plurality of like teeth arranged in series along said bottom edge, said multiple sets being spaced from one another along said bottom edge, the teeth of said multiple sets of teeth being shaped to mesh with the teeth of said first set of teeth when said lid is screwed onto said container, said multiple sets of teeth being located so that when said lid is attached to said container by a screwing action involving engagement of said first and second screw thread means, one set of said multiple sets of teeth will mesh with said first set of teeth whereby removal of said lid from said container by a reverse screwing action is prohibited by interference of said first set of teeth with one of the multiple sets of teeth on said skirt, said skirt also having a plurality of latch lugs formed integral with and projecting down from said bottom edge, said latch members being uniformly spaced circumferentially along said bottom edge in alternating relation with said plurality of sets of teeth, said catch element and said latch lugs being located so that when said lid is attached to said container by said screwing action, one of said latch lugs will be in a position relative to said catch element whereby removal of said lid by a reverse screwing action will be prohibited by interference of said one latch lug by said catch element.

2. A container/lid combination according claim 1 wherein said skirt is sufficiently resilient to be cammed inwardly by engagement of a latch lug with said catch element when said lid is attached to said container by said screwing action.

3. A container/lid combination according to claim 2 wherein said lid has a circular inner wall spaced from said skirt so as to define a channel therebetween, and further wherein said inner wall fits into the open end of said container when said lid is attached to said container.

4. A container/lid combination according to claim 1 wherein said teeth of said multiple sets of teeth are of sawtooth shape.

5. A container/lid combination according to claim 1 wherein said screw threads are arranged so that attachment of said lid is achieved by rotating it in a first direction relative to said container, and removal of said lid is achieved by rotating it in a second opposite direction relative to said container, and further wherein said teeth on said container and lid are arranged so that when the teeth of one set of teeth on said lid are engaged with the teeth on said tab, the teeth on said tab will allow movement of the engaged teeth on said lid in said first direction but will interfere with movement of said engaged teeth in said second opposite direction.

6. Apparatus according claim 1 wherein each of said grooves is defined by a first side surface and a second inclined surface, with said first side surfaces being located between said second inclined surfaces and defining opposite edges of said tab.

7. Apparatus according claim 1 wherein said flange has an outer edge, and a portion of said tab projects beyond said outer edge of said flange.

8. A lid/container combination comprising:

a lid made of a resilient elastic and having a depending skirt with a bottom edge, said skirt having an internal surface, first screw thread means on said internal surface, multiple sets of teeth formed integral with and depending from said bottom edge, said multiple sets of teeth being spaced from one another along said bottom edge of said skirt, and a plurality of mutually spaced latch lugs formed integral with and depending from said bottom edge of said skirt; and a container having an open top end, a closed bottom end, and a side wall with an outer surface extending from said open top end to said closed bottom end, second screw thread means on said outer surface adjacent said open top end, said second screw thread means being adapted to mate with said first screw thread means whereby said lid may be attached to said container by rotating said lid in a first direction to engage said first screw thread means with said second screw thread means and detached from said container by rotating said lid in a second opposite direction to disengage said first screw thread means from said second screw thread means, a circumferentially-extending flange formed integral with and projecting radially outward from said outer surface of said side wall, said flange having an upper surface and being located adjacent to said second screw thread means with said second screw thread means being located between said open top end and said flange, a tab member constituting a section of said flange, said tab member having an upper side characterized by a set of upwardly projecting teeth in position to be engaged by one of the multiple sets of teeth depending from said bottom edge of said skirt when said lid is screwed onto said container, whereby to lock said lid to said container, said flange also having a pair of radially-extending circumferentially-spaced tearable sections of reduced thickness demarcating opposite sides of said tab member whereby said tab member can be (a) broken away from said flange by tearing said sections of reduced thickness along said opposite sides and (b) moved downward so as to move said upwardly projecting teeth out of engagement with any of said multiple sets of teeth on said skirt, and a catch element formed integral with said upper surface, said latch lugs and said catch element being disposed so that when said lid is screwed onto said container said catch element will intercept one of said latch lugs and cam it and said skirt radially inward far enough to allow said one latch lug to pass by said catch element, whereby said skirt is free to return to its original shape and unscrewing of said lid from the container is blocked as a consequence of said catch element being in intercepting relation with said one latch lug.

9. A lid/container combination according to claim 8 further characterized in that said skirt may be bent inwardly to allow a latch lug to pass by said catch element when said lid is urged to rotate in a direction to unscrew it from said container.

10. A lid/container combination according to claim 8 wherein said flange has an outer edge and said tab has an outer portion that projects radially outward of said outer edge of said flange.

11. A container/lid combination comprising:

a container comprising a bottom wall and a side wall formed integral with the bottom wall, said side wall being circular in cross-section and increasing in diameter with increasing distance from said bottom wall, said side wall defining an open top end for said container and having an exterior surface, first screw thread means on said exterior surface of said side wall adjacent to said open top end, a peripheral flange formed integral with and projecting radially outward from said exterior surface below and spaced from said first screw thread means, said flange having a section thereof demarcated as a tab by two mutually spaced radially-extending tab-tear grooves in said flange, said tab having an upper surface facing in the direction of said first screw means and a first set of teeth of saw-tooth shape projecting upward from said upper surface and extending In series between said grooves, said grooves having a depth such that opposite radially-extending edges of said tab are connected to adjacent portions of said flange by thin flange sections that are tearable along the length of said grooves to allow said tab to be bent downward out of the plane of said flange, and a catch element formed integral with and projecting upwardly from said flange; and a circular lid having a main body section and a rim section formed integral with and surrounding said main body section, said rim section comprising a depending wall of circular cross-sectional shape, said depending wall having an internal surface and a bottom edge and being sized to surround said side wall at the top end of said container, a plurality of second screw thread means on said internal surface of said depending wall, said second screw thread means being adapted to make a screw connection with said first screw thread means whereby said lid may be attached to said container to close off said open top end of the container; and multiple sets of teeth formed integral with and projecting downwardly from said bottom edge of said depending wall, each set of said multiple sets of teeth comprising a plurality of like teeth arranged in series along said bottom edge and said multiple sets of teeth being spaced uniformly from one another along said bottom edge, the teeth of said multiple sets of teeth being shaped to mesh with the teeth of said first set of teeth when said lid is screwed onto said container, said multiple sets of teeth being located so that when said lid is attached to said container by a forward screwing action involving engagement of said first and second screw thread means, one set of said multiple sets of teeth will mesh with said first set of teeth whereby removal of said lid from said container by a reverse screwing action is prohibited by interference of said first set of teeth with said one of the multiple sets of teeth on said depending wall, and a plurality of latch lugs formed integral with and projecting down from said bottom edge of said depending wall, said latch lugs being uniformly spaced circumferentially along said bottom edge in alternating relation with said multiple sets of teeth;

said catch element and said latch lugs being equally spaced from a center axis common to said container so that said catch element will intercept one of said latch lugs when said lid is being attached to said container by said forward screwing action, said depending wall being capable of flexing inwardly and said catch element being shaped so that (a) when said lid is rotated in a direction to initiate said forward screwing action said catch element will exert a camming action on said intercepted latch lug that causes said depending wall to flex inwardly enough to allow said intercepted latch lug to move past said catch element and permit completion of said forward screwing action, and (b) after said lid has been attached to said container by said forward screwing action, said catch element will interfere with said intercepted latch lug to prevent removal of said lid by said reverse screwing action until said depending wall has been depressed inwardly by a manually applied force far enough to allow said intercepted latch lug to pass by said catch member.

* * * * *